US005771028A

United States Patent [19]

Dalton et al.

[11] Patent Number: 5,771,028

[45] **Date of Patent: *Jun. 23, 1998**

[54] IDENTIFICATION OF LIQUID CRYSTAL DISPLAY PANELS

[75] Inventors: Scott W. Dalton; Doyne L. Metz, both of Cypress, Tex.

[73] Assignee: Compaq Computer Corporation, Houston, Tex.

[ * ] Notice: The term of this patent shall not extend beyond the expiration date of Pat. No. 5,495,263.

[21] Appl. No.: 525,338

[22] Filed: Sep. 7, 1995

Related U.S. Application Data

[63] Continuation of Ser. No. 188,522, Jan. 28, 1994, Pat. No. 5,495,263.

[51] Int. Cl.[6] ..... G09G 5/00

[52] U.S. Cl. ..... 345/3; 345/99; 345/213

[58] Field of Search ..... 354/1–3, 132, 354/213, 10; 395/501, 520

[56] References Cited

U.S. PATENT DOCUMENTS

| | | | |
|---|---|---|---|
| 4,855,728 | 8/1989 | Mano et al. . | |
| 4,908,842 | 3/1990 | Collins . | |
| 4,964,069 | 10/1990 | Ely | 345/132 |
| 5,072,411 | 12/1991 | Yamaki | 395/520 |
| 5,184,059 | 2/1993 | Patino et al. . | |
| 5,257,350 | 10/1993 | Howard et al. | 395/501 |
| 5,262,759 | 11/1993 | Moriconi et al. . | |
| 5,276,458 | 1/1994 | Sawdon | 345/132 |
| 5,285,197 | 2/1994 | Schmidt et al. | 345/213 |
| 5,355,073 | 10/1994 | Nguyen . | |
| 5,375,210 | 12/1994 | Monnes et al. | 395/501 |
| 5,457,473 | 10/1995 | Arai et al. | 345/10 |
| 5,467,470 | 11/1995 | Ninomiya | 345/904 |
| 5,479,183 | 12/1995 | Fujimoto | 345/3 |
| 5,495,263 | 2/1996 | Dalton et al. | 345/3 |

OTHER PUBLICATIONS

'Monitor Identification Technique', IBM Technical Disclosure Bulletin, vol. 30, No. 2, pp. 839–840 (Jul. 1987).

'Display Controller Set Up as a Function of Display Monitor Type, Display Jumber Settings and Amount of VRAM', IBM Technical Disclosure Bulletin, vol. 33, No. 2, pp. 352–353 (Jul. 1990).

*Primary Examiner*—Steven Saras

*Attorney, Agent, or Firm*—Pravel, Hewitt, Kimball & Krieger

[57] ABSTRACT

A method that identifies the type of LCD panel used in a portable computer system based on the frequency of the oscillator signal of the DC-to-AC inverter in the LCD panel. In this method, only one signal is routed from the LCD panel to the base unit of the portable computer system for the purpose of panel identification. The inverter oscillating signal is used to increment a counter during power on operations. A system counter, which is clocked by a system clock, is used to determine the number of system clocks needed for the panel identification counter to reach a predetermined count. That number is compared with the entries of a table, in which each entry corresponds to a type of LCD panel. In this manner, the type of LCD panel can be identified based on the frequency of the inverter signal. A corresponding entry in a second table is accessed to obtain a table entry for the identified LCD panel to a full table of LCD panel parameters. The table entry is stored in a predetermined location in the Video ROM. During the video power on portion of the BIOS, the video BIOS routines access the predetermined location in the Video ROM to obtain the parameters to properly initialize the video controller.

12 Claims, 5 Drawing Sheets

IDENTIFICATION OF LIQUID CRYSTAL DISPLAY PANELS

This is a continuation of application Ser. No. 08/188,522, filed Jan. 28, 1994 now U.S. Pat. No. 5,495,263.

SPECIFICATION

BACKGROUND OF THE INVENTION

1. Field of the Invention

The invention relates to the identification of liquid crystal display panels, and more particularly, to determining the type of the liquid crystal display panel based on the frequency of an oscillating signal generated in the liquid crystal display panel.

2. Description of the Related Art

In recent years, with the increasing popularity of portable computer systems, the variety of liquid crystal displays (LCDs) available to the user has increased dramatically. An LCD panel comprises an array of display elements known as pixels. Each pixel on the LCD panel can be one of two states, on or off. In its "on" state, the pixel allows light to be transmitted, whereas in its "off" state, the pixel prevents light from passing through. The pixels are activated by electronic drivers located in the LCD panel. The electronic drivers are controlled by a video controller located in the base unit of the portable computer system. The LCD panel is typically divided into an upper and lower half, with the upper half being connected to a set of upper column drivers and the lower half being connected to a set of lower column drivers.

Since driving a liquid crystal at direct current (DC) triggers an electrode reaction inside the liquid cell that results in a rapid deterioration of the display quality of the liquid cell, an alternating current (AC) driving method must be utilized. Two AC driving methods exist: static and multiplex. In the static driving method, each display pixel must be driven by a dedicated liquid crystal driver circuit, thereby making the static method unsuitable for a liquid display with a large number of display pixels. In the multiplex method, each row of pixels in the LCD panel is driven by a corresponding common driver, while each column in the upper half of the panel and each column in the lower half of the panel are driven by a corresponding upper column driver and a corresponding lower column driver, respectively. The waveforms of the signals generated by the common and column drivers define which pixels are activated. Since each pixel in the LCD panel is defined by a common signal and an upper or lower column signal, depending on which half of the LCD panel the pixel is located, the combination of the two multiplexed AC signals determine whether the accessed pixel is activated. The video controller provides the control and data signals to the drivers to manipulate the pixels on the LCD panel to produce the desired image.

Different types of LCD panels can be utilized in a portable computer system. As each type of LCD panel has different characteristics, the video controller must be initialized differently for the different types of panels. The video controller is initialized during the computer's Power On Self Test (POST) procedure. For proper initialization of the video controller, the computer must be informed of the type of LCD panel. Parameters associated with the different types of LCD panels are stored in a Video Read Only Memory (Video ROM). During POST, the computer first identifies the LCD panel type, and then accesses the appropriate location in the Video ROM to obtain the power on parameters corresponding to the LCD panel. The computer utilizes those parameters to properly initialize the video controller. In prior systems, the LCD panel type was indicated by providing a number of additional pins from the LCD panel to the portable computer system. Thus, by encoding the additional pins with certain values, the computer is able to determine the type of LCD panel being used. A disadvantage of this method is the number of extra wires that are required to be routed from the LCD panel to the base unit of the portable computer system. Further, as the number of panels that can be used with a given video controller changes, so must the number of pins, quickly reaching pin and wiring problems, as noted above, and cost, logistical and standardization problems with LCD panel vendors.

Thus, a method of determining the LCD panel type is desired that does not require unnecessary pins or additional components to be provided by the LCD panel.

SUMMARY OF THE PRESENT INVENTION

The method according to the present invention relates to identifying an LCD panel based on the frequency of the oscillating AC signal generated by oscillator circuitry located in the LCD panel. Once identified, the video controller is initialized as appropriate for the type of LCD display panel. By determining the type of LCD display panel based only on the frequency of the oscillating signal, only one wire is required to be provided from the LCD display panel to the base unit of the portable computer system for the purpose of LCD panel identification. As a result, the number of wires that are routed between the LCD panel and the portable computer system can be reduced.

To determine the frequency of the oscillating signal, a counter is used that is clocked by the oscillating signal. The counter is implemented in an ASIC already located in the computer system for providing other control functions. During the Power On Self Test (POST) procedure, the counter is started. After starting the counter, the computer reads the count value of a system counter, which is being clocked by a computer system clock. The computer waits until the counter being clocked by the oscillating signal reaches a predetermined count value, whereupon the computer reads the count value of the system counter again. The computer subtracts the second count value of the system counter from the first count value to determine the number of system clocks required for the first counter to reach the predetermined count value. The subtracted value is compared with the entries of a Video ID Table stored in system memory. If a match occurs, the location of the Video ID Table where the match occurred is identified and the corresponding entry in a second table is accessed. The second table contains pointer address values associated with different LCD display panels. The pointer address values in the second table point to the starting addresses in the Video BIOS ROM that contain the parameters associated with the different types of LCD display panels. The pointer address obtained from the second table is then stored in a predetermined location in the Video BIOS ROM. When the computer is performing an initialization of the video controller, it accesses the predetermined location in the Video BIOS ROM to obtain the pointer address value to the LCD panel parameters.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Figure 1:
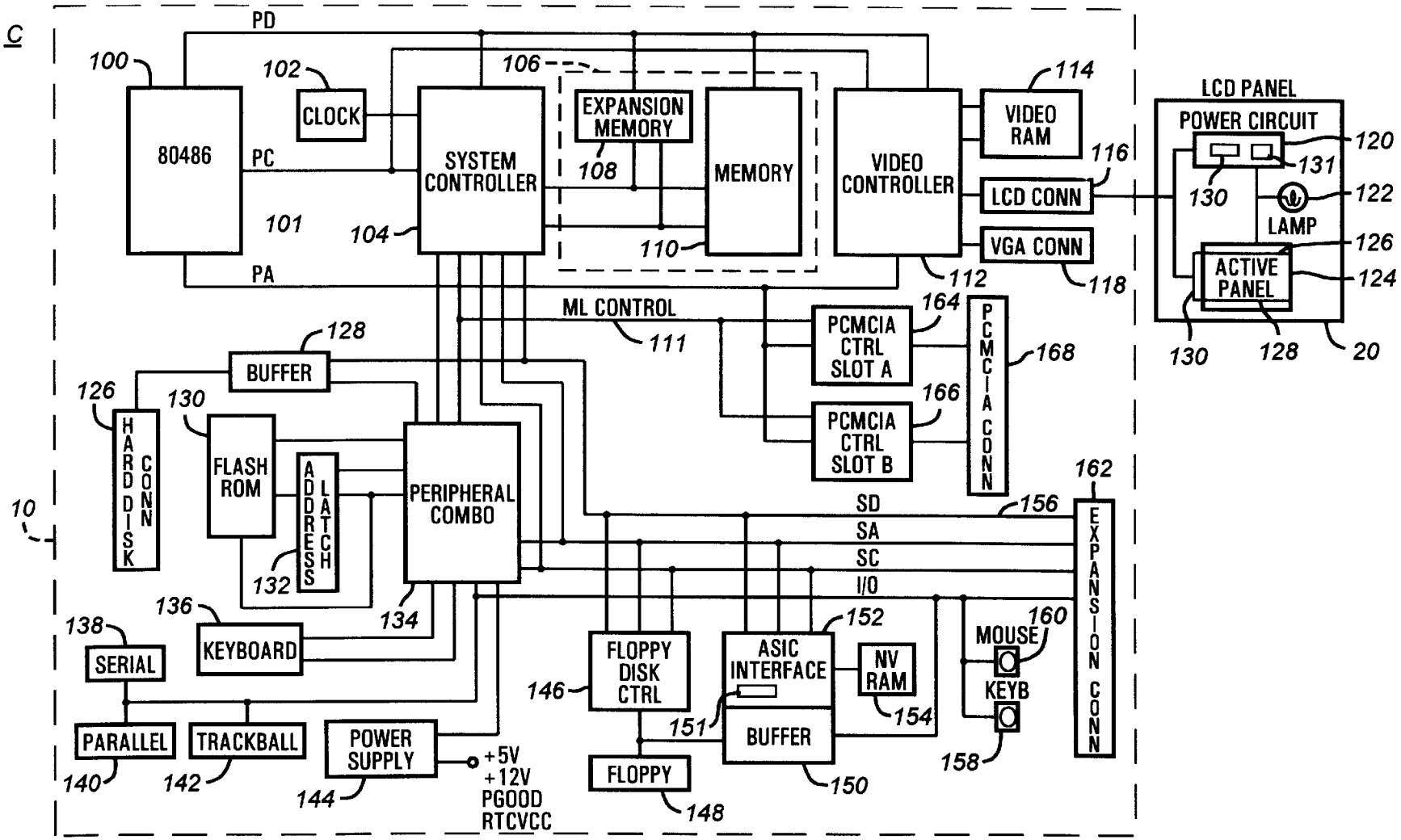
FIG. 1 is a portable computer system incorporating the preferred embodiment of the present invention.

Referring now to FIG. 1, a portable computer system C incorporating the preferred embodiment according to the present invention is shown. The portable computer system C includes a base unit 10 being connected to an LCD panel 20. A microprocessor 100, preferably an S-series i486 processor from Intel Corporation (Intel), forms the main computing element of the computer C. The microprocessor 100 is connected to a system controller 104 via a local bus 101, which consists of three buses: a PD or processor data bus, a PA or processor address bus and a PC or processor control bus. Connected to the system controller 104 is a clock generator 102. Included as part of the system controller 104 is a memory controller, which provides the proper address and control signals to main memory 106. The main memory 106 is connected to the PD or processor data bus. The main memory 106 includes a base memory 110, which is configured to 4 Megabytes or 8 Megabytes in the preferred embodiment, and is upgradable with expansion memory 108. The system controller 104 also provides certain control signals on an ML control bus 111. The ML control bus 111 signals are used in conjunction with address and data signals placed on the PA bus by the system controller 104 during intervals when the system controller 104 has gained access to the PA bus from the processor 100. This dual use of the PA bus reduces the pin count of the system controller 104.

An ISA bus 156 is also included as part of the computer system C. The ISA bus 156 has four major components, the SA or system address bus, the SD or system data bus, the SC or system control bus and the I/O bus. The system controller 104 further includes control circuitry that provides the necessary capabilities to convert between local bus 101 cycles and ISA bus 156 cycles. The system controller 104 also includes buffers to provide the necessary data and address transceiving functions between the local bus 101 and the ISA bus 156.

The computer system C includes certain fundamental components such as an interrupt system, a DMA controller and a number of timers, as well as arbitration of the ISA bus 156. These functions are all contained in a peripheral controller 134, which is connected to the SA, SC, I/O, PA and ML control buses. The peripheral controller 134 also provides the necessary control signals to a hard disk buffer 128, which is connected between the SD bus and a hard disk connector 126 for connection with a hard disk drive (not shown). The peripheral controller 134 also provides an interface to a keyboard 136, an internal trackball 142, a serial port 138 and a parallel port 140. In addition, the peripheral controller 134 provides control signals for a FLASH EEPROM 130, which stores certain basic operating routines to allow the computer to boot and perform certain fundamental system functions. These routines are generically referred to as the BIOS. A portion of the EEPROM 130 is used to store the Video BIOS, which is used to initialize the video system. That portion of the EEPROM 130 is generally referred to as the Video BIOS ROM.

A power supply 144 provides the power supply voltages for the portable computer system C. The voltages generated by the power supply 144 includes a 3.3V power voltage +3.3V, a 5V power voltage +5V, a 12V power voltage +12V, a signal PGOOD indicating the availability of system power and a voltage RTCVCC. The voltage RTCVCC is connected to a real time clock (RTC) and a CMOS memory located in the system controller 104.

A floppy disk controller 146 is connected to the ISA bus 156. The floppy disk controller 146 provides control signals to a floppy disk drive (not shown) through a connector 148. The floppy disk controller 146 also provides data and address transceiving between the SD and SA buses, respectively, and the floppy disk drive. Connected between the floppy connector 148 and the I/O bus is a buffer 150. The buffer 150 is implemented inside an ASIC 152. The ASIC 152 also provides control signals for an NVRAM 154, which is non-volatile memory for storage of configuration and status information.

An expansion connector 162 is connected to the ISA bus 156 for connection to an external expansion base. Also connected to the I/O bus are a mouse port 160 and a keyboard port 158 for connection with an external mouse and external keyboard, respectively. A PCMCIA connector 168 has two PCMCIA slots, which provide expansion capabilities for the computer system C to provide additional memory if desired or to receive certain communication options, such as modems and networks cards. The two PCMCIA slots in the connector 168 are connected to two PCMCIA controllers 164 and 166. The PCMCIA controller 164 is used for the control of PCMCIA slot A and the PCMCIA controller 166 is used for the control PCMCIA slot B. The PCMCIA controllers 164 and 166 are connected to the PA and ML control buses.

The video system in the portable computer system C comprises a video controller 112, a Video Random Access Memory (VRAM) 114, an LCD connector 116, a VGA connector 118, and an LCD panel 20. The video controller 112 is connected to the local bus 101, and it provides video and control signals to the LCD panel 20 through the LCD connector 116. The video controller 112 also can provide video signals to an external CRT monitor (not shown) through the VGA connector 118. The VRAM 114 is connected to the video controller 112 for storage of video data. The video data are provided by the video controller 112 through the LCD connector 116 to LCD drivers 126, 128 and 130 inside the LCD panel 20 to activate the pixels of an active panel 124. The LCD drivers include upper column drivers 126, lower column drivers 128, and common drivers 130. Also provided to the LCD panel 20 through the LCD connector 116 are DC power supply voltages of +5 volts and +18 volts, which are connected to a power supply circuit 120 in the LCD panel 20. The active panel 124 requires a light source 122 for illumination of the pixels. In the preferred embodiment, the light source 122 is a fluorescent lamp requiring an AC power supply voltage. Consequently, the power supply circuit 120 of the LCD panel 20 must convert the computer system DC voltages to an AC voltage. The conversion is performed by a DC-to-AC inverter 130, which is part of the power supply circuit 120. Suitable inverters are well known to those skill in the art. The inverter 130 is developed on a suitable circuit board. Also contained on the circuit board is a simple oscillator circuit 131 which provides an oscillating signal designated as a signal PANEL_

Figure 1A:
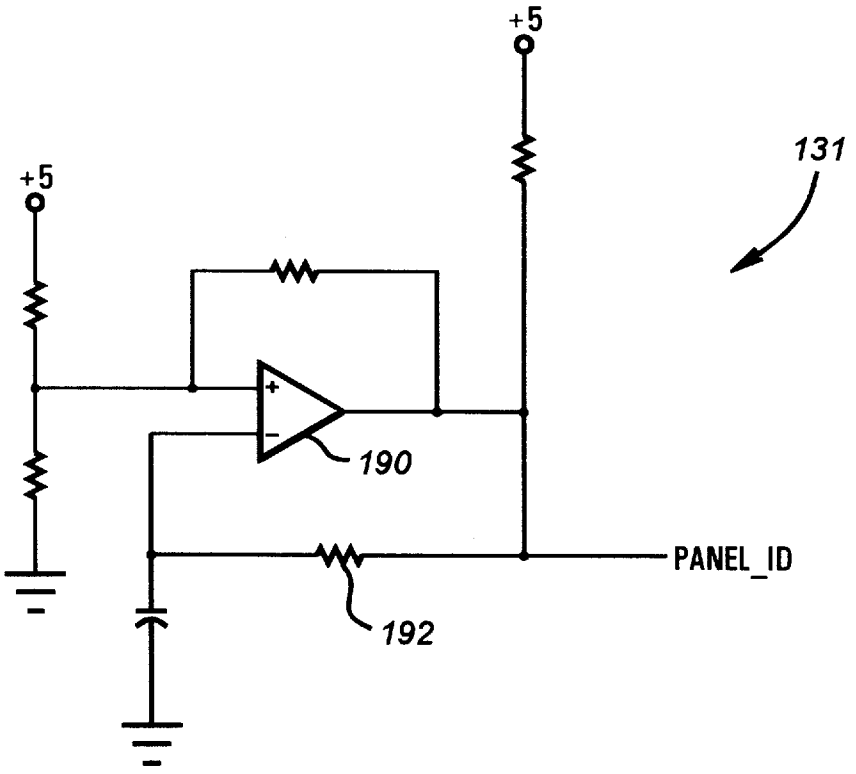
FIG. 1A is a schematic diagram of an oscillator for use according to the present invention.

ID. Any one of numerous simple oscillating circuits as well known to those skilled in the art can be utilized. The oscillator circuit 131 of the preferred embodiment is shown in FIG. 1A. A comparator 190 forms the basic active element and varying values of a resistor 192 are used to vary the oscillating frequency between different LCD panels. It is noted that the oscillator circuit 131 is added to the circuit board to assist in the identification function and is not otherwise used in the LCD panel 20. The oscillating signal PANEL_ID is provided to the base unit 10 of the portable computer system C through the LCD connector 116. The frequency of the oscillating signal PANEL_ID is varied with each type of LCD panel 20 used. The signal PANEL_ID is provided from the LCD connector 116 directly to a counter 151 implemented in the ASIC 152.

Figure 2:
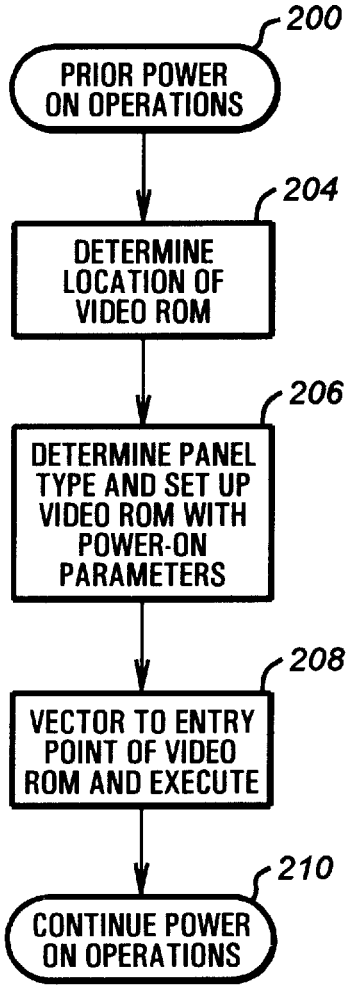
FIG. 2 is a flow chart of the portion of the computer Power On Self Test (POST) procedure relating to the initialization of the video controller.

Referring now to FIG. 2, the portion of the Power On Self Test (POST) procedure relating to the initialization of the video controller 112 is shown. In step 200, the computer has completed prior power on operations of the computer system C. One of these prior operations has been the shadowing of the Video BIOS ROM, where the ROM data has been copied to a portion of the memory 106, which portion of the memory then has its logical address changed to that of the Video BIOS ROM, with the actual Video BIOS ROM being removed from the system memory map. Control proceeds to step 204, where the computer determines the location of the Video BIOS ROM data, now shadowed in the memory 106. It is noted that the location of the Video ROM data is flexible, and thus can be assigned to several locations. After the location of the Video ROM is determined in step 204, control proceeds to step 206, where the computer determines the type of LCD panel 20 and sets up the Video ROM with the appropriate power on parameters. Step 206 is described in more detail below in FIGS. 3A and 3B. Next, in step 208, control transfers to the entry point of the Video BIOS ROM, and the video BIOS routines in the Video ROM are executed. The video BIOS routines perform a self-test, which includes the functions of setting the video controller 112 to a known state, checking the vertical and horizontal sync timing using the computer system clock, and checking the VRAM 114. If the self-test detects a problem, an error code is written to predefined I/O diagnostic ports. After the self-test is performed, the video BIOS routines initialize the video controller 112. The video BIOS routines access the LCD panel parameters stored in the Video ROM to properly initialize the video controller 112 according to the LCD panel specifications. The initialization includes the loading of programmable registers in the video controller 112 with data according to the type of LCD panel. After all the routines in the Video ROM have been executed, control proceeds to step 210, where control returns to the system BIOS ROM, which is the main BIOS section, to continue other power on operations of the computer system C.

Figure 3A:
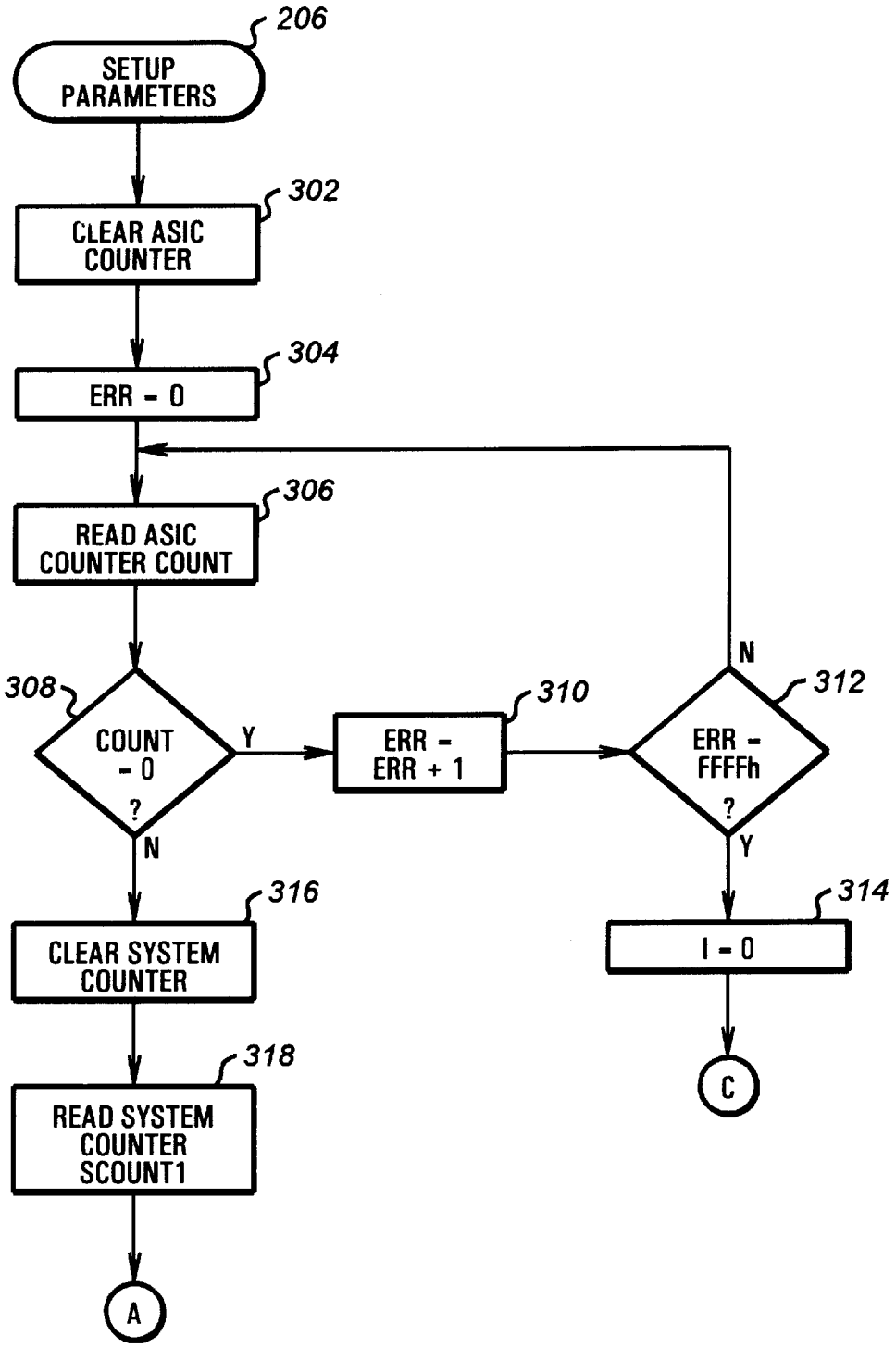
FIGS. 3A and 3B show a flow chart for the determination of the LCD panel type.
Figure 3B:
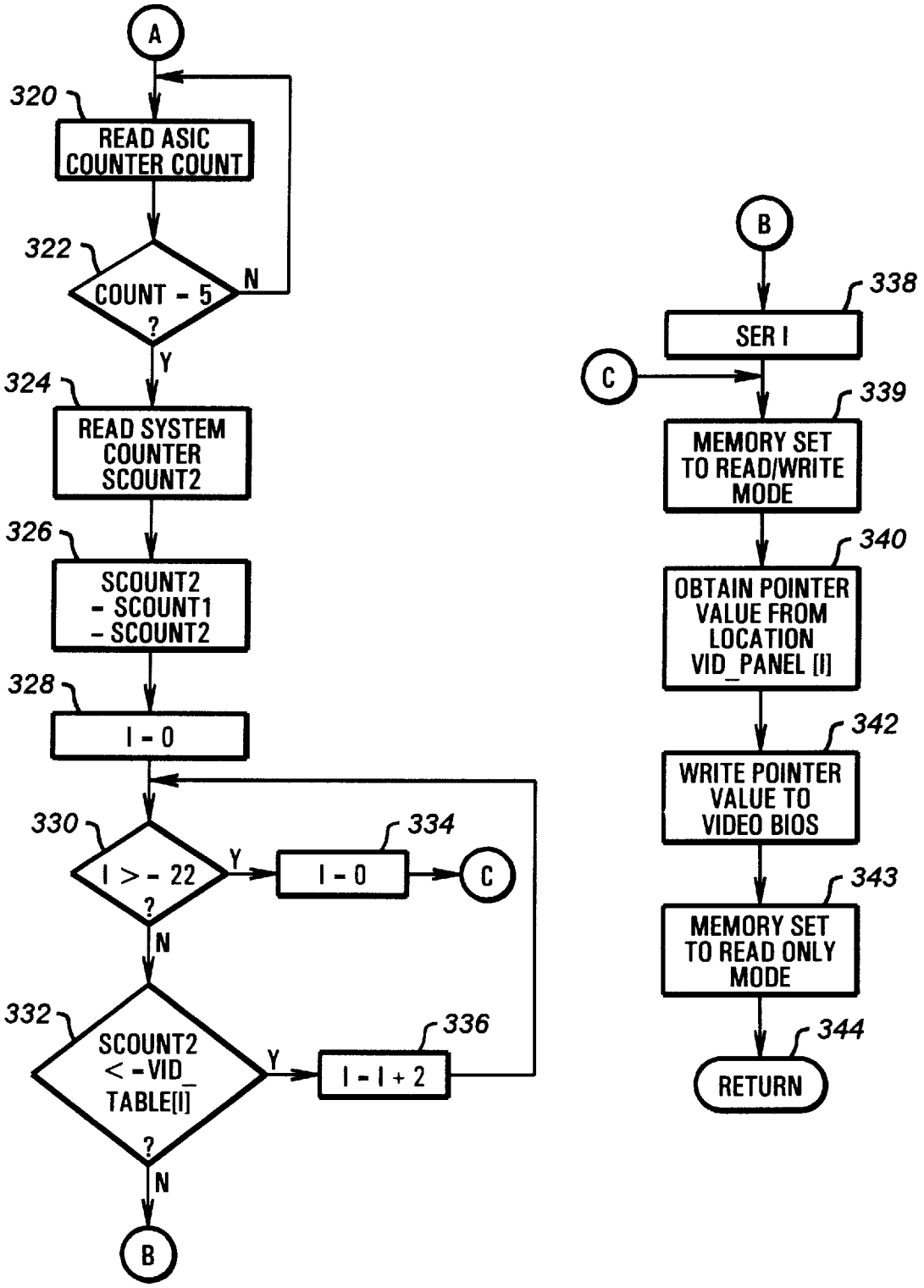

Referring now to FIGS. 3A and 3B, the Video BIOS ROM is set up with the parameters corresponding to the type of LCD panel used. As discussed above, a counter 151 is implemented in the ASIC 152. The counter 151 is incremented by the oscillating signal PANEL_ID, which is supplied by the inverter 130 included in the power supply circuit 120 in the LCD panel 20. In step 302, the ASIC counter 151 is reset and cleared. After the counter 151 is reset, an error variable ERR is set to 0 in step 304. Next, the state of the counter 151 is read in step 306. In step 308, it is determined whether the counter 151 has incremented. If the counter 151 has not incremented, then control proceeds to step 310, where the error variable ERR is incremented. Next, in step 312, it is determined if the error variable ERR is equal to the value FFFFh. If not, control proceeds back to step 306, where the state of the counter 151 is read again. Control then proceeds to step 308 again to determine if the counter 151 has incremented. This process is repeated until it is determined that the counter has incremented or the error variable ERR has been incremented to the value FFFFh. If the error variable ERR has incremented to the value FFFFh, then control proceeds from step 312 to step 314, where an offset index I is set to zero, indicating that no LCD panel is present. However, if it is determined in step 308 that the counter 151 has incremented, control proceeds to step 316, where a system counter contained in the peripheral controller 134 is reset and cleared. The system counter is incremented by a system clock of approximately 2 MHz provided by the clock generator 102. Next, in step 318, the value of the system counter is read and stored in a temporary storage location SCOUNT1. Control then proceeds to step 320, where the state of the counter 151 is read. Next, in step 322, it is determined if the counter 151 has incremented to the value 5. If not, control returns back to step 320, where the state of the counter 151 is again read. This process is repeated until it is determined that the counter 151 has incremented to the value 5, in which case, control proceeds from step 322 to step 324, where the value of the system counter is read and stored in a temporary storage location SCOUNT2. Next, in step 326, the value stored in SCOUNT2 is subtracted from the value stored in SCOUNT1 as the system counter is a down counter. If an up counter were utilized, then SCOUNT1 would be subtracted from SCOUNT2. The subtracted value is written into the temporary storage location SCOUNT2. The value in SCOUNT2 represents the number of system clocks that have occurred for the counter 151 to reach the value 5. Stated in another way, the value in SCOUNT2 is approximately equal to 4 times the ratio of the period of the oscillating signal to the period of the system clock used in the particular system counter. It is noted that the value 5 used has been arbitrarily chosen. If greater resolution is desired, a larger value could have been used.

Arrays VID_TABLE and VID_PANEL are used by the parameter set up routine to make a determination of the LCD panel type, which can then be used to determine the pointer address to the proper parameters in the Video ROM. The arrays VID_TABLE and VID_PANEL are shown below in Tables 1 and 2, respectively. In the preferred embodiment, the arrays VID_TABLE and VID_PANEL are stored in the system BIOS, which has also previously been shadowed to the main memory 106. Each entry in the array VID_TABLE is one word in length, while each entry in the array VID_PANEL is one byte in length. As a consequence, 22 bytes of storage space are required to store the entries of the array VID_TABLE, while only 11 bytes of storage space are necessary to store the entries of the array VID_PANEL. As shown in Table 1, offset 0 of VID_TABLE corresponds to a bad panel, offset 2 corresponds to an LCD panel having an oscillator frequency of 10 kHz, offset 4 corresponds to an LCD panel having an inverter oscillating frequency of 12 kHz, and so forth. Each entry in the array VID_TABLE represents the maximum value that corresponds to the type of LCD panel associated with the next entry in VID_TABLE. For example, a 10 kHz panel actually corresponds to a value greater than 036Ah but less than or equal to 0477h. Similarly, an 18 kHz panel corresponds to a value greater than 01E9h or less than or equal to 024Eh.

TABLE 1

| VID_TABLE | | |
|---|---|---|
| OFFSET | VALUE | TYPE OF PANEL |
| 0 | 0477H | Bad panel |
| 2 | 036Ah | 10 kHz |
| 4 | 02CDh | 12 kHz |
| 6 | 024Eh | 15 kHz |
| 8 | 01E9h | 18 kHz |
| 10 | 017Eh | 22 kHz |
| 12 | 0122h | 30 kHz |
| 14 | 00E0h | 39 kHz |
| 16 | 00AAh | 51 kHz |
| 18 | 0078h | 68 kHz |
| 20 | 0044h | 103 kHZ |

TABLE 2

| VID_TABLE | | |
|---|---|---|
| OFFSET | VALUE | TYPE OF PANEL |
| 0 | 0EFh | No panel |
| 1 | 02h | 10 kHz |
| 2 | 0EFh | 12 kHz reserved |
| 3 | 18h | 15 kHz |
| 4 | 18h | 18 kHz |
| 5 | 18h | 22 kHz |
| 6 | 13h | 30 kHz |
| 7 | 1Ah | 39 kHz |
| 8 | 0EFh | 51 kHz reserved |
| 9 | 0EFh | 68 kHz reserved |
| 10 | 13h | 103 kHz |

As shown in Table 2, offset 0 of the array VID_PANEL contains a table value which is used by the Video BIOS to indicate that no panel or a bad panel exists. Offset 1 of VID_PANEL contains a table or panel value indicating the parameters for an LCD panel having an oscillator frequency of 10 kHz. Offset 2 of VID_PANEL contains the same table value as offset 0 because an LCD panel having an oscillator frequency of 12 kHz is reserved for future use. Thus, any LCD panel having an oscillator frequency of 12 kHz would be categorized as a bad or non-existent panel. Offsets 3, 4 and 5 of VID_PANEL contain the same table value, which is used to point to the location in the Video ROM containing the set of parameters for a 15 kHz, 18 kHz or 22 kHz LCD panel. Offset 6 of VID_PANEL contains the table value used to select the parameters of a 30 kHz LCD panel. Offset 7 of VID_PANEL contains the table value used to select the parameters of a 39 kHz LCD panel. Offsets 8 and 9 of VID_PANEL contain the same table value as offset 0, which indicates that LCD panels having inverter frequencies of 51 kHz or 68 kHz frequencies are reserved for future use, and therefore would be categorized as no panels. Finally, offset 10 of VID_PANEL contains the table value used to access the parameters of a 103 kHz LCD panel. It is understood that the table entries are determined based on the oscillating frequencies selected for the various LCD panels. Of course, more entries could be added to the tables if more panels were needed and finer resolution could readily be obtained by waiting more intervals of the counter 151.

It is noted that the entries in the array VID_TABLE and in the array VID_PANEL are in the same order; that is, the first two entries of VID_TABLE correspond to the first entry of VID_PANEL, the next two entries of VID_TABLE correspond to the next entry in VID_PANEL, and so forth.

Referring to FIG. 3B again, after step 326 has been performed, control proceeds to step 328, where the offset index I is set to zero. Next, in step 330, it is determined if the offset index I is greater than or equal to 22. If not, control proceeds to step 332, where the value stored in the temporary location SCOUNT2 is compared to the entry in VID_TABLE at offset I. If the value in SCOUNT2 is less than or equal to the value contained in VID_TABLE at offsets I and I+1, control proceeds to step 336, where the offset index I is incremented by a value of 2. Control proceeds back to step 330, where it is again determined if the offset index I is greater than or equal to 22. If not, the value in SCOUNT2 is again compared to the value contained in VID_TABLE at offsets I and I+1. Thus, as long as the value in SCOUNT2 is less than or equal to the value contained in VID_TABLE at offsets I and I+1, steps 330, 332 and 336 are repeated. If in step 332, it is determined that the value in SCOUNT2 is greater than the value contained in VID_TABLE at offsets I and I+1, control proceeds to step 338. However, if steps 330, 332 and 336 are repeated eleven times, the offset index I is incremented to the value 22, which indicates that all the entries in VID_TABLE have been read. This signifies that the value contained in SCOUNT2 is less than any entry in the array VID_TABLE. As a result, control proceeds from step 330 to step 334, where the offset index I is set to zero.

If in step 332, it is determined that the value in SCOUNT2 is greater than the value contained in VID_TABLE at offsets I and I+1, control proceeds to step 338. In step 338, the binary shift right operation is performed on the offset index I to divide it by two to act as a byte offset rather than a word offset. Control then proceeds from step 338 to step 339, where the memory containing the shadowed copy of the video ROM is set to read/write mode from read only mode. Control then proceeds to step 340, where the table value stored in the array VID_PANEL at offset I is obtained. The table value is used by other routines in the video ROM to identify the location where the proper LCD panel parameters are stored. In step 342, the table value is written to a predetermined location in the Video BIOS ROM. This can be done as the data is actually in the RAM which was just made read/write. Thus, during the execution of the Video BIOS routines in step 208 in FIG. 2, this predetermined location in the Video ROM is accessed to obtain the proper table value, which is then used to enter a table having parameters for the various LCD panels. The routines then retrieve the LCD panel parameters to initialize the video controller 112. After the table value has been written to the predetermined location in the Video ROM in step 342, control proceeds to step 343, where the shadowed copy of the video ROM, as now altered to include the proper LCD panel table entry, is again made read only. Control then is returned to the calling program in step 344.

If it is determined in step 330 that the offset index I is greater than or equal to 22, indicating that the value stored in SCOUNT2 is less than any entry in the array VID_TABLE, then control proceeds to step 334, where the offset index I is set to zero to indicate a bad panel. From step 334, control proceeds to step 339. Similarly, if it is determined in step 312 that the counter 151 has been read FFFFh times without being incremented, indicating that either no panel is connected to the computer C or the LCD panel 20 is defective, control proceeds to step 314, where the offset index I is set to zero. Next, control proceeds to step 339.

It is understood that instead of waiting for a given count of the counter 151, a predetermined time, for example, as determined by a given count value in the system counter, could be allowed to elapse and then the value in the counter 151 could be read. This alternative is not preferred because of the greater time required to obtain satisfactory resolution of the count value to distinguish the various LCD panels.

A method has been described that identifies the type of LCD panel used in a portable computer system based on the frequency of an oscillating signal in the LCD panel. In this method, only one signal is routed from the LCD panel to the base unit of the portable computer system for the purpose of panel identification. The oscillating signal is used to increment a counter during power on operations. A system counter, which is clocked by a system clock, is used to determine the number of system clocks needed for the panel identification counter to reach a predetermined count. That number is compared with the entries of a table, in which each entry corresponds to a type of LCD panel. In this manner, the type of LCD panel can be identified based on the frequency of the oscillating signal. A corresponding entry in a second table is accessed to obtain the a table entry value associated with the parameters of the identified LCD panel. The table entry is stored in a predetermined location in the Video ROM. During the video power on portion of the BIOS, the video BIOS routines access the predetermined location in the Video ROM to obtain the parameters to properly initialize the video controller.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

We claim:

1. A method of identifying the type of a liquid crystal display panel for use in a computer system, wherein the liquid crystal display panel receives a plurality of video signals including a pixel clock and pixel data, the method comprising the steps of:

providing an oscillating signal having a period and which is generated in the liquid crystal display panel, said oscillating signal being other than said plurality of video signals;

determining a value that represents the relation between said oscillating signal period and the period of a computer system clock signal; and comparing said value with the entries of a table to determine the type of the liquid crystal display panel.

2. The method of claim 1, wherein the computer system clock signal period is less than said oscillating signal period.

3. The method of claim 1, wherein said determining step includes the steps of:

receiving the oscillating signal from the liquid crystal display panel;

counting in a first counter from a first value using the oscillating signal;

storing an initial count value of a second counter being clocked by said system clock signal substantially when said first counter has been started;

waiting until said first counter reaches a second value a predetermined count difference from said first value;

storing a final count value of said second counter substantially when said first counter has counted to said predetermined count difference from said first value; and determining the difference between said initial count value and said final count value.

4. The method of claim 1, wherein said determining step includes the steps of:

receiving the oscillating signal from the liquid crystal display panel;

counting from a first value in a first counter using said computer system clock signal;

storing an initial count value of a second counter being clocked by the oscillating signal substantially when said first counter has been started;

waiting until said first counter reaches a second value a predetermined count difference from said first value;

storing a final count value of said second counter substantially when said first counter has counted to said predetermined count difference from said first value; and determining the difference between said initial count value and said final count value.

5. A method of initializing a video controller that provides a plurality of video signals including a pixel clock and pixel data to a liquid crystal display panel in a computer system, wherein the video controller is initialized with parameters stored in a storage device which contains different sets of parameters associated with different types of liquid crystal display panels, the method comprising the steps of:

identifying the type of liquid crystal display panel, said identifying step including the steps of:

providing an oscillating signal having a period generated in the liquid crystal display panel, said oscillating signal being other than said plurality of video signals;

determining a value that represents the relation between said oscillating signal period and the period of a computer system clock signal; and comparing said value with the entries of a table to determine the type of the liquid crystal display panel; and retrieving from the storage device the set of parameters associated with the identified type of the liquid crystal display panel for initializing the video controller.

6. The method of claim 5, wherein the computer system clock signal period is less than said oscillating signal period.

7. A computer system, comprising:

a microprocessor;

a liquid crystal display panel receiving a plurality of video signals and including a generator for generating an oscillating signal having a first period, said oscillating signal being other than said plurality of video signals;

a video controller which provides said plurality of video signals;

a clock generator producing a clock signal having a second period;

an analyzer responsive to said oscillating signal and said clock signal for determining a value that represents the relation between said oscillating signal period and said clock signal period; and a storage device coupled to said microprocessor for storing a first table containing values that represent different types of liquid crystal display panels, wherein said microprocessor compares said relation value with said first table values to determine the type of said liquid crystal display panel.

8. The computer system of claim 7, wherein said clock signal period is less than said oscillating signal period.

9. The computer system of claim 7, further comprising:

a storage device coupled to said microprocessor for storing parameters of different types of liquid crystal display panels, wherein said microprocessor retrieves the parameters associated with the determined type of liquid crystal display panel from said storage device for initializing said video controller.

10. The computer system of claim 7, wherein said analyzer includes:

a first counter coupled to said liquid crystal display panel to receive said oscillating signal, said counter counting from a first value when said oscillating signal is asserted;

a second counter connected to said clock generator to receive said clock signal, said second counter counting when said clock signal is asserted;

a circuit connected to said first counter and said second counter for storing an initial count value of said second counter substantially when said first counter has started incrementing, waiting until said first counter reaches a second value a predetermined count difference from said first value before storing a final count value of said second counter; and a subtractor connected to said storage device for determining the difference between said initial count value and said final count value.

11. The computer system of claim 7, wherein said analyzer includes:

a first counter connected to said clock generator to receive said clock signal, said first counter counting from a first value when said clock signal is asserted;

a second counter coupled to said liquid crystal display panel to receive said oscillating signal, said second counter counting when said oscillating signal is asserted;

a circuit connected to said first counter and said second counter for storing an initial count value of said second counter substantially when said first counter has started incrementing from said first value, waiting until said first counter reaches a second value a predetermined count difference from said first value before storing a final count value of said second counter; and a subtractor connected to said initial count value and final count value storage means for determining the difference between said initial count value and said final count value.

12. The computer system of claim 7, further comprising:

a storage device coupled to said microprocessor for storing parameters of different types of liquid crystal display panels, wherein said first table storage device further contains a second table, wherein the entries of said second table correspond with the entries of said first table, wherein a match occurring in said first table causes said microprocessor to access the corresponding entry in said second table, and wherein the entries in said second table are references into said storage device to obtain the parameters for the type of liquid crystal display panel.

* * * * *